US008114485B1

(12) United States Patent
Schwendimann et al.

(10) Patent No.: US 8,114,485 B1
(45) Date of Patent: Feb. 14, 2012

(54) WATER RESISTANT SHRINKABLE MEDIUM FOR RECEIVING INK

(75) Inventors: Jodi A. Schwendimann, Minnetonka Beach, MN (US); Nabil F. Nasser, Dayton, OH (US); Earl Pickering, Hopkins, MN (US)

(73) Assignee: NuCoat, Inc., Plymouth, MN (US)

( * ) Notice: Subject to any disclaimer, the term of this patent is extended or adjusted under 35 U.S.C. 154(b) by 315 days.

(21) Appl. No.: 12/584,818

(22) Filed: Sep. 11, 2009

Related U.S. Application Data

(60) Provisional application No. 61/234,064, filed on Aug. 14, 2009.

(51) Int. Cl.
*B41M 5/00* (2006.01)

(52) U.S. Cl. ..... 428/32.18; 428/32.34; 428/423.1; 428/688; 428/908.8; 428/913; 427/243

(58) Field of Classification Search ..... 428/32.18, 428/32.34, 423.1, 688, 908.8, 913; 427/243
See application file for complete search history.

(56) References Cited

U.S. PATENT DOCUMENTS

| | | | | |
|---|---|---|---|---|
| 6,157,865 | A | 12/2000 | Cromett | |
| 6,180,256 | B1 | 1/2001 | Sargeant | |
| 6,602,585 | B2 * | 8/2003 | Graney | 428/212 |
| 7,168,802 | B2 * | 1/2007 | Kondo | 347/100 |

* cited by examiner

*Primary Examiner* — Betelhem Shewareged
(74) *Attorney, Agent, or Firm* — Schwegman, Lundberg & Woessner, P.A.

(57) ABSTRACT

The present subject matter includes apparatus and methods for a heat shrinkable water resistant image medium. The method can include providing a shrinkable coating comprising a polyurethane dispersion and applying the coating to a shrinkable substrate. The shrinkable substrate and the shrinkable coating are configured to accept ink, shrink when exposed to heat and, after shrinking, retain the ink when the substrate and coating are exposed to moisture.

20 Claims, 3 Drawing Sheets
(1 of 3 Drawing Sheet(s) Filed in Color)

WATER RESISTANT SHRINKABLE MEDIUM FOR RECEIVING INK

PRIORITY AND RELATED APPLICATIONS

This application claims the benefit under 35 U.S.C. 119(e) of U.S. Provisional Patent Application Ser. No. 61/234,064, filed Aug. 14, 2009, which is incorporated by reference herein in its entirety.

TECHNICAL FIELD

This patent document pertains generally to a shrinkable medium for receiving ink and to related methods for printing the shrinkable medium.

BACKGROUND

Miniature works of art, such as miniature pictures or miniature decorations on jewelry articles, date back to antiquity. The art of making miniature items of decoration has progressed from actually drawing or painting a small image on a small article.

OVERVIEW

One embodiment of the present invention includes a method for making an ink-jet printed, water resistant shrinkable article. The method comprises providing a shrinkable substrate and providing a coating that comprises a modified polyurethane resin. The coating is applied to the shrinkable substrate. Indicia are imparted to the coating with an ink jet printer, laser printer, thermal printer, markers or color pencils, for example. The coated substrate with the ink-based indicia is then shrunk without wrinkling. Advantageously, the shrunk article retains ink indicia when exposed to moisture, such as water.

Another embodiment of the present invention includes a water resistant ink receptive sheet for making miniature printed articles. The sheet comprises a shrinkable substrate and a shrinkable coating adhered to the substrate. The coating is comprised of a modified polyurethane resin. The coating is adapted to receive ink jet indicia and to shrink with the substrate when heated. The coating is smooth and unwrinkled when the article is shrunken and retains the ink indicia even when exposed to moisture.

Another embodiment of the present invention includes a kit such as a kit for making jewelry or ornaments. The kit comprises a container and shrinkable ink jet printed articles that are enclosed within the container. In some embodiments, the kit comprises shrinkable ink jet printed articles or unprinted shrinkable sheets and instructions for use.

BRIEF DESCRIPTION OF THE DRAWINGS

This patent document file contains at least one drawing executed in color. Copies of this patent document in the form of a patent or patent application publication with color drawings will be provided by the Office upon request and payment of the necessary fee.

DETAILED DESCRIPTION

One embodiment of the present invention includes a method for making a miniature article with a surface comprised of a water soluble modified polyester, a film and ink printed indicia, the indicia having sharp definition and having adherence to an underlying heat shrinkable medium. The method includes providing the heat shrinkable medium and applying a compatible, shrinkable, ink-receptive coating to the heat shrinkable medium. The method includes optionally corona treating the surface of the heat shrinkable medium prior to application of the shrinkable coating.

The shrinkable coating comprises a modified water soluble polyester resin material comprised of about 7 to 55% of a modified-polyethylene resin or polyester resin, 90% of which is at a glass transition temperature of 100° Centigrade and 10% of which is greater than the glass transition temperature of 100° Centigrade and a film. In one embodiment, the shrinkable coating comprises an ink receptive coating. The ink receptive coating comprises a polyester polymer that is modified with polyvinyl alcohol and acrylic resin and cationic resin as a die fixing agent with a range of 0 to 70 percent by weight. One range embodiment is 0 to 40 percent. The shrinkable coating is applied to the shrinkable medium. The method further includes printing the applied shrinkable coating with an ink such as ink from an ink jet process. The method additionally includes heating the heat shrinkable medium and the shrinkable coating for about 2 to 10 minutes at a temperature within a range of about 400+/−10° F. or subjecting to baking conditions to shrink the heat shrinkable medium and the shrinkable coating to a degree that is about 25 percent of their original size or less.

Figure 1:
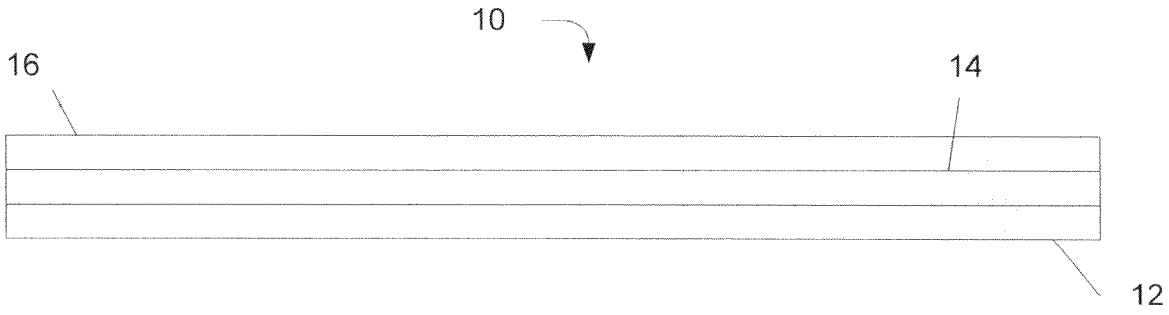
FIG. 1 is a cross-sectional view of one embodiment of a shrinkable article of the present invention.

Another embodiment of the present invention includes a miniature article with an outer surface comprised of a substantially smooth, modified water soluble polyester. Miniature ink-printed indicia with a sharp definition are on the smooth outer surface. The ink-printed indicia include ink jet printed indicia. One cross-sectional view of the miniature article, illustrated at 10 in FIG. 1 comprises a heat shrinkable substrate 12, and a coating that comprises a film 14 that overlays the substrate 12 and a modified polyester overlay 16 that overlays the film 14.

The coating and heat shrinkable medium shrink together so that the outer coated surface is smooth and not wrinkled and remains adhered to the substrate. The ink jet printed indicia on the coating have sharp definition both before and after shrinkage. The ink jet printed indicia are believed to be bound to the coating.

The shrinkable substrate 12 is, in one embodiment, in a form of a sheet of a shrinkable material such as polystyrene or biaxially-oriented polypropylene. The substrate is shrinkable in an "X" dimensional direction to about 25% of the original dimension and is shrinkable in a "Y" dimensional direction to about 25% of the original dimension after heating the base substrate at about 120 to 170° C. typically and, for some embodiments, 300° C., for about five minutes. The "X" dimensional direction and the "Y" dimensional direction are perpendicular to each other and are in a plane formed by the substrate. In various embodiments, the substrate includes biaxially oriented polystyrene, laminated in two-layers perpendicular to one another.

Concurrent with its shrinkage in the "X" and "Y" dimensional directions, is an expansion of the base substrate in a "Z"

dimension direction that is perpendicular to the plane formed by the substrate. Upon heating, the base substrate not only shrinks in both the "X" and "Y" dimensional directions, but expands in a "Z" dimensional direction to become both dimensionally smaller in the "X" and "Y" dimensional directions, and thicker in the "Z" dimensional direction. The shrinkable coating also shrinks in accordance with this shrinkage pattern to avoid wrinkling.

In one embodiment, the shrinkable substrate 12 is corona treated. Corona treatment may, for some embodiments, improve adherence of a coating to the substrate.

One embodiment of the method of the present invention includes applying a coating to the substrate that can receive an ink jet print, that is shrinkable, and that comprises a water-based polyester material. In one embodiment, the coating overlay 16 employed is designated, NS-244LX, or NS-282 or WAC-10 and is manufactured by Takamatsu Oil and Fat Company, Ltd., of Osaka, Japan. This material includes an n-propanol concentration of about 1.8% by weight, a modified polyester resin concentration of about 15% by weight, and a water concentration of about 83.2% by weight. This coating material has a boiling point of 100° C. and a specific gravity of 1.032 at 20° C. The material is a white emulsion that has a slightly alcoholic odor.

Other embodiments of the present invention apply a coating which includes a polyester resin and a urethane resin and is known as WAC-15, also manufactured by Takamatsu Oil & Fat Co., Ltd. The WAC-15 is free of organic solvent. The viscosity of the coating is about 500 cps and is adjustable with care.

Another modified polyester resin overlay material that may be employed in the method of the present invention include a modified polyester resin designated NS-282LX, manufactured by Takamatsu Oil and Fat Company, Ltd., of Osaka, Japan. This coating material has a modified polyester concentration that forms a clear layer after drying and that has good jet ink absorption. The modified polyester has a good adhesion to polyester and polyvinyl chloride films. The coating is applied to a thickness of about 8 to 12 microns.

The 282 LX modified polyester resin has an appearance of a white emulsion and a modified polyester concentration of 15%+/−1 percent by weight. The viscosity of the modified polyester resin is less than 1000 centipoise at 25° C. The resin pH at 25° C. is 4-6. The 282 LX resin is nonionic and may, for some embodiments, include n-propyl alcohol in a concentration of 2.0% by weight. At low temperatures, the viscosity increases dramatically. The viscosity is reduced by heating at 40° C.

Another coating embodiment utilizes a modified polyester resin known as NS-244LX, also manufactured by Takamatsu Oil and Fat Company, Ltd., of Osaka, Japan. This material has an n-propanol concentration of about 1.8% by weight, a modified polyester resin concentration of about 15% by weight, and water in a concentration of about 83.2% by weight. The specific gravity of this material is 1.032. The vapor density of the material is 5+/−1. The modified polyester resin material is soluble in water. All of the resins utilized in the present invention are water soluble and water based.

Another coating embodiment utilizes an emulsion resin that includes a linear polyester of high molecular weight, known as NS-246LX. The NS-246LX is also manufactures by Takamatsu Oil & Fat, Ltd. Of Osaka, Japan. The NS-246LX coating has good ink absorption and good ink fixation. The coating also includes polyvinylalcohol and resin, NS-246LX. This coating has a non-volatile content of about 15% by weight, a viscosity of 1000 cps at 25 degrees Centigrade, a color of milky white, a pH of 4 to 6. The coating is a nonionic coating and includes about 2% n-propyl alcohol. The coating is dried in a still environment at about 110 degrees Centigrade.

Another coating embodiment utilizes a linear polyester of high molecular weight, polyvinylalcohol and acrylic resin which is known as NS-286LX and is manufactured by Takamatsu Oil & Fat Co., Ltd., of Kyutaro-machi Chuoh-ku, Osaka, Japan. The NS-286LX coating has good ink absorption and good ink fixation, especially for direct and acid dyes. The coating has a good adhesion to films such as polyester and does not bronze. The coating has a good water resistance, is resistant to curl after coating and has a lustrous surface. The coating is applicable as a thin layer, 4 to 12 microns. The coating has a non-volatile content of about 15% by weight; a viscosity of 1000 cps at 25 degrees Centigrade; a pH of 4-6 and contains about 2% normal propyl alcohol. This coating is dried at a temperature of about 110 degrees Centigrade, in still air. The coating is applicable by die coating, roller coating knife coating, blade coating, and kiss roll coating.

Other modified polyester resin coating formulations that may be employed in the method and coating of the present invention include NS-63W, manufactured by Takamatsu Oil and Fat Company, as well as PES-513E, also manufactured by Takamatsu Oil and Fat Company. These modified polyester materials make a clear layer after drying on a substrate. Coatings prepared with the modified polyester resin materials have good ink absorption, including good absorption of ink used in ink jet printing. The coating embodiments prepared with these resins have good adhesion to films such as polyester and polyvinyl chloride. Coatings have good water resistance and may be layered to a relatively thin thickness, such as about eight to twelve microns.

One other coating usable in the method of the present invention is a color changeable coating that is activated by temperatures, thermochromic, or UV light, photochromic, with and without ink jet receptive coating. Inks are obtained from Matsui in coatings activated thermochromically. Photopia inks from Matsui are used in coatings activated photochromically.

In various embodiments, the shrinkable medium includes a substrate and one or more coatings configured to receive an image and shrink when subjected to heat. In Some embodiments, the substrate is coated on one side. In other embodiments, the substrate is coated on both sides. The one or more coatings applied to the substrate are configured to retain the image, even when subjected to moisture, after the article is shrunk.

In various embodiments, the one or more coatings include a primer. In some embodiments, only one side of the substrate may include a primer. The primer is configured as a balance between the substrate and one or more other coatings, such that, the primer absorbs tension between the substrate and other coatings, for example, as the substrate and other coatings shrink. In some embodiments, the primer is configured to receive ink.

In various examples, one or more of the one or more coatings includes a polyurethane dispersion to provide adhesion of the coating to the substrate or other coatings, and to provide water resistance to the shrunk article.

In various embodiments, a primer coating includes a polyurethane dispersion, a polyether-type polyurethane dispersion, a polycarbonate-type polyurethane dispersion or a combination thereof. The selected dispersion or combination may include an anionic dispersion, a cationic dispersion or a nonionic dispersion. The polyurethane dispersions comprise between 5 and 75% by weight of the primer. In various embodiments, the primer may be used as the only coating for the substrate, for example, a primer including one or more of the polyurethane dispersions above and colloidal silicate or alumina oxide will provide a shrinkable substrate with excellent ink absorption and water resistance characteristics. Primers including one or more polyurethane dispersions tend to provide deeper penetration of ink so as to allow better setting of an image on the shrinkable article.

A primer, according to some embodiments, may include acrylic styrene, acrylic or a combination thereof.

Embodiments of a primer may include styrene maleic anhydride, styrene maleimide resin, styrene maleic anhydride acid resin or combination thereof, all of which may be referred to as SMA materials. In some embodiments, SMA materials may be combined with a polyurethane dispersion to form a primer. In various embodiments, an SMA primer includes polyvinylpyrrolidone (PVP), a homopolymer soluble in water and a polar solvent. In some embodiments, the SMA primer may include a crosslinker. In various SMA primers, a polyurethane dispersion enhances adhesion characteristics of the primer.

In some embodiments, a shrinkable, water-resistant coating includes a polyurethane (from about 5-90%, 30-80%, or 35-70%) to fix ink or other die. SMA may be combined with the polyurethane, or, in various embodiments, SMA is used in lieu of polyurethane. In various embodiments, the coating includes the use of a cross-linker (e.g., with XAMA®7 (polyfunctional aziridine) or BayCoat 20). In some embodiments, the coating includes polyvinylpyrrolidone (PVP) (from about 5-60%, 8-50%, or 15-35%). PVP may optionally cross-link with XAMA®7, for example. In one embodiment, a coating includes long chain, molecular weight polymers, such as high-molecular weight polyvinyl alcohol (PVA). Such polymers may be cross-link with XAMA®7 or glyoxal, for example.

In various embodiments, a primer includes co-polymer materials such as vinylpyrrolidone or vinylcaprolactam. Such primers have a cationic character which is cross linkable to a polyurethane dispersion to form a water resistant film layer. Various commercial copolymers include Viviprint 540, Viviprint 200, Viviprint PS10 and PVPK90, for example. A copolymer primer may be used alone or with polyvinyl alcohol, and/or with a polyvinyl dispersion.

In various embodiments, a shrinkable, water-resistant coating includes a polyamide co-polymer from about 2-40%, 5-30%, or 8-20% by weight to help provide ink receptivity. Co-polymers can be configured to melt and encapsulate ink when shrunk, thereby providing water resistivity.

In various embodiments, a shrinkable medium will include a ink reception layer separate from a primer layer. In some embodiments, a shrinkable medium will include both a primer layer and an ink receptive layer. Other embodiment may only have only one layer. In various single layer embodiments, the layer may be applied to the substrate in one or more coating passes. Various ink receptive layer coatings include SMA materials in portions of up to 40% by weight. Such ink receptive coatings enhance water resistance and ink absorbability. Various SMA ink receptive coatings are used with a primer to enhance adhesion of the ink receptive coating to the substrate or ither underlying coatings.

Figure 2:
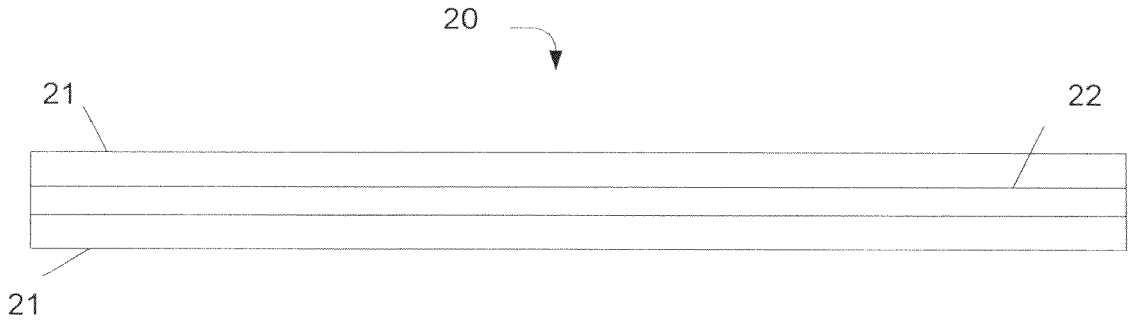
FIG. 2 shows a water resistant, shrinkable ink jet sheet, according to one embodiment of the present subject matter.

FIG. 2 shows a water resistant, shrinkable, ink jet sheet 20 according to one embodiment of the present subject matter. The ink receptive, shrinkable medium includes a shrinkable substrate 22 and an ink-receptive coating 21. In various embodiment, the substrate 22 includes a coating 21 on both a first side and a second side. In some embodiments, the coating includes more than one layer, for example a priomer layer and an ink receptive layer. In some embodiments the substrate 22 is coated on only one side. The coating is adapted to receive ink, such as from an ink jet printer. The coating and the substrate are designed to shrink together when exposed to heat. Additionally, as the coating shrinks, it protects both the ink and the underlying substrate from moisture such that the shrunk article does not lose an ink image when exposed to moisture.

The shrinkable substrate 22 is coated with a formulation as discussed above. In various embodiments, the substrate is coated on to a polystyrene base using a slot die at about 8 lbs/3000 $ft^2$. Various embodiments include coating weights between about 2-20 lbs., 2-15 lbs., 2-10 lbs., or 6-8 lbs. It is understood that other coating weights are possible without departing from the scope of the presents subject matter.

In various embodiments, one or more primer layers are applied to the substrate before coating. Primers are applied using a range of coating weights, for example, but not limited to, about 0.1 grams/square meter ($g/m^2$) to about 25 ($g/m^2$) or about 0.1 ($g/m^2$) to about 15 ($g/m^2$).

In some embodiments, coating the substrate is done in two layers, a primer layer and a ink receptive layer. In various embodiments, a coating uses a water-reducible blocked polyisocyanate and a hydroxyl-functional polyurethane dispersion. The dispersion may be in the ink-receptive layer, primer layer or both. In various embodiments, the coating provides a glossy finish. A matt finish may be provided via the use of silica, clay, calcium carbonate, titanium or alumina in a coating.

A coated substrate is configured to receive indicia such as from an ink jet printer, laser printer, thermal printer, markers and/or pencils. Subjecting the coated substrate to an elevated temperature causes the substrate and coating to shrink. Shrinking is accomplished over range of temperatures such as between 300° F. and 425° F. Shrinkage of the article will occur faster at higher temperatures, for example about 1-2 minutes at 425° F. The substrate and coating shrink at nearly the same rate, thus maintaining sharpness and definition to the applied image. Also, configuring the coating to shrink at the same rate as the substrate reduces stress in each of the components and reduces or eliminates cracks in the coating. In various embodiments, the coated substrate and image shrink to about 25% of the original size of the substrate. Upon shrinking the coated substrate, the ink receptive coating becomes water resistant such that ink used to form an image on the coating is embedded in the article and does not dissipate when subjected to moisture, such as water. This feature allows the articles to be used as charms to decorate items, such as hats, shoes and sandals, or parts of the body, such as wrists and ankles, that may be exposed to moisture. The shrunk articles are very tough and tolerate many harsh environments kids may find, such as mud puddles, without losing the intensity of the image formed by the ink.

Figure 3:
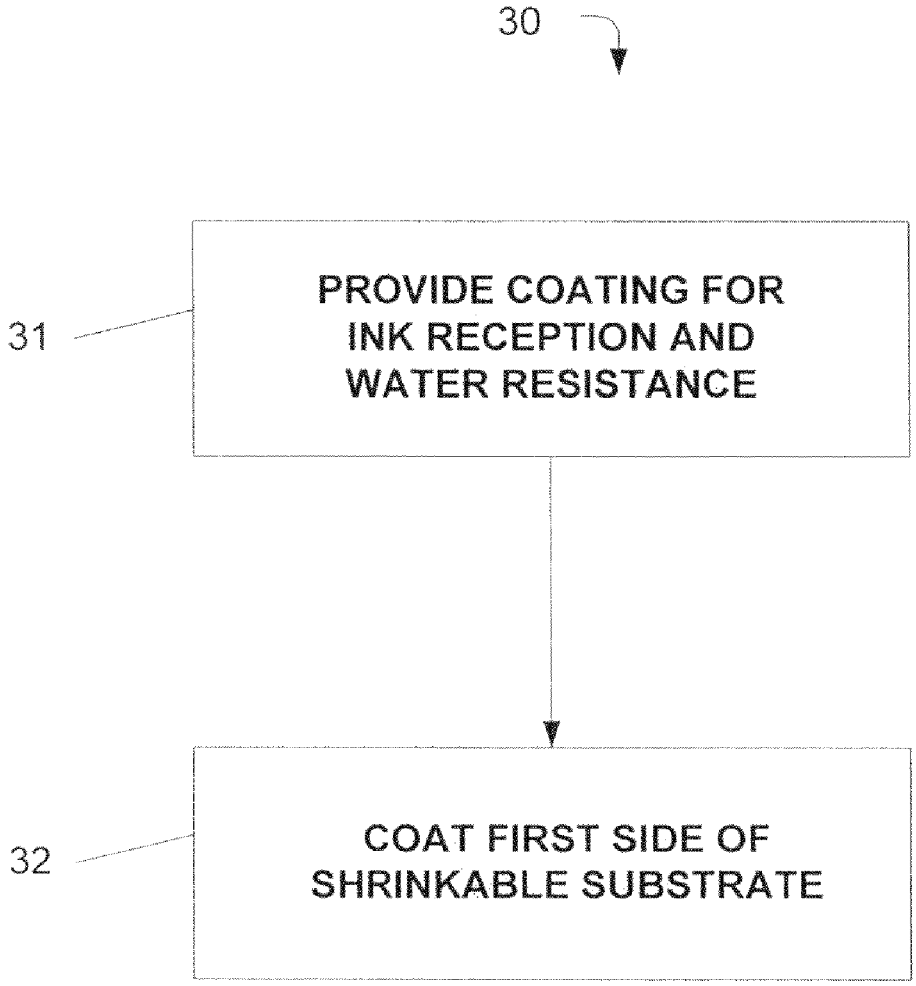
FIG. 3 shows a flowchart of a method for making a water resistant, shrinkable image sheet, according to one embodiment of the present subject matter.

FIG. 3 shows a flowchart of a method 30 for making a water resistant, shrinkable image sheet according to one embodiment of the present subject matter. The method includes providing a ink-receptive coating configured to be water resistant upon shrinking 31, and coating a first side of a shrinkable substrate 32, such as polystyrene, for example.

In various embodiments, the coating is applied to both sides of the substrate such that an article can include an image on both sides.

Other method embodiments include adding a phosphorescent pigment that is coated on to the substrate without an ink-receptive layer; a product with an ink receptive coating on one or both sides that incorporates the phosphorescent pigments; and a product with an ink receptive coating on one side and the phosphorescent pigments incorporated in a polymer matrix on the other side. Phosphorescent pigments usable in the present invention include, but are not limited to, doped zinc sulfide pigments and strontium sulfide pigments.

Ink jet printing uses jets of colored ink, similar in appearance and consistency to fountain pen ink. The ink is ejected through a nozzle under pressure and is transformed into uniform droplets by vibration of a piezoelectric crystal. The droplets are charged electrostatically and are deflected by a computer or other digital image-generating device. Any type of ink jet printing may be used in the method of the present invention. Methods include a computer activated single nozzle, a bank of nozzles, bubble-jet and phase-change technology.

Indicia printed on the shrinkable coated surface include letters as well as color or luminescent images. Ink for the color images includes dyes that have different spectral and reflective characteristics from pigments. Images also include holographic images and images that glow in the dark.

Various forms of printing typically requires a surface that has a capacity to dry the impinging drops of ink by absorption without wicking or spreading of the ink for maximum printing density and sharpness. It has surprisingly been found that the coating used in the process and article of the present invention receives ink and does not require a material such as silica or calcium carbonate to impart clarity and sharpness of the indicia.

Various forms of printing may be used to make indicia such as letters, symbols, or dots used to make an image such as a face or an animal or other image. Print from the ink jet printing may have a variety of colors. Print may be used to make holograms. Print, for some embodiments, glows in the dark.

In some embodiments, a magnetic substrate is laminated to the back of the article. In some embodiments, a magnetic coating is applied to the back of the article.

Figure 4:
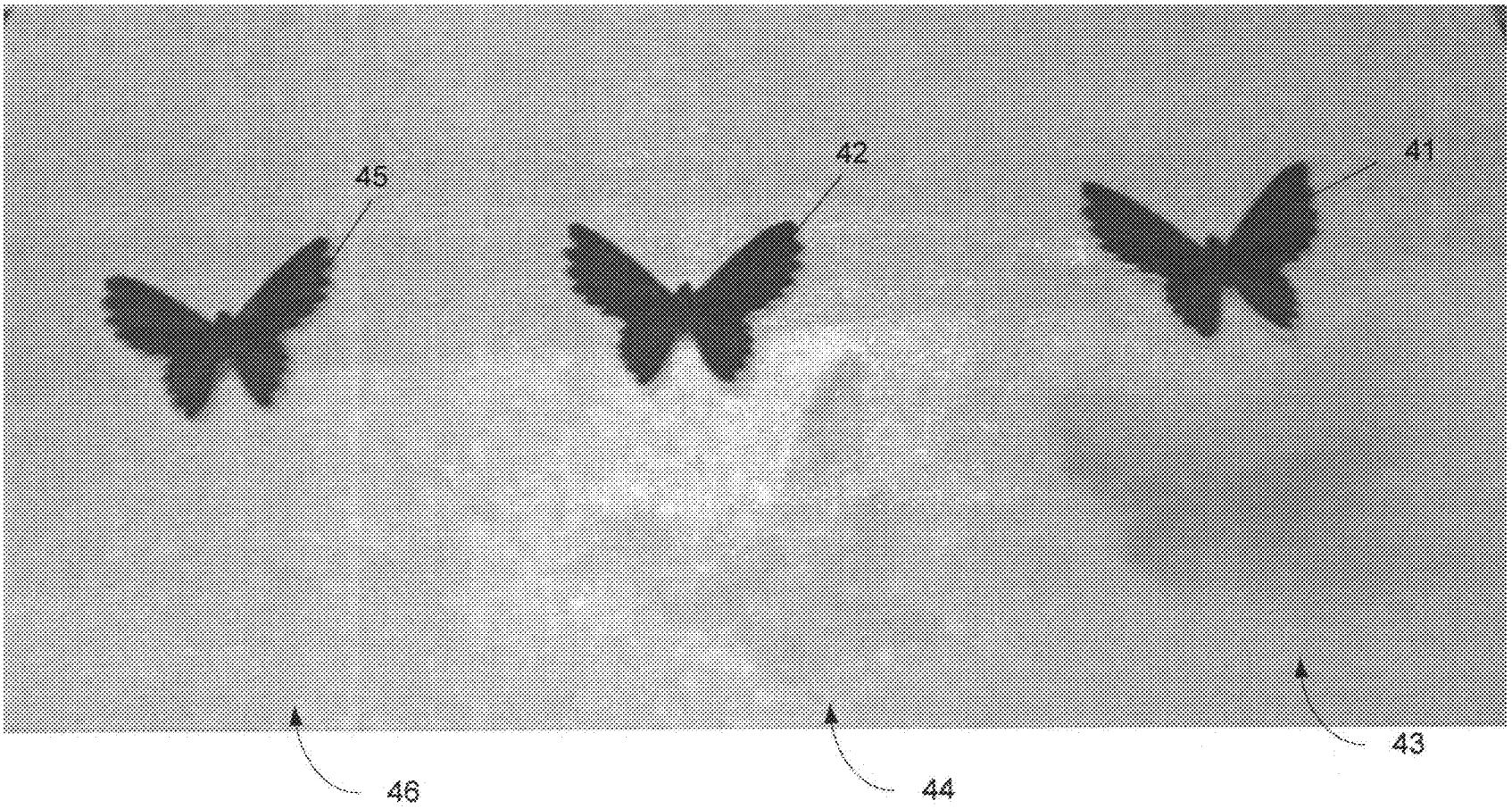
FIG. 4 is a color illustration showing improved water resistance of a water resistant, shrinkable article, according to one embodiment of the present subject matter.

FIG. 4 is a color illustration showing water resistance of a present water resistant, shrinkable article relative to a non-water resistant, shrinkable article. Each of the illustrated shrinkable articles 41, 42, 44 were printed and shrunk according to recommended instructions of each article. The articles were then subjected to moisture and placed on a paper towel. The articles were then moved from their original position on the paper towel. The article on the right 41 and the article in the middle 42 show signs indicating the printed image is disturbed by exposure to moisture. The signs include color shadows 43, 44 of the articles where they were first placed on the paper towel. The exposure to moisture caused the color to separate from each of the articles 41, 42.

In contrast, an embodiment 45 of an article according the present subject matter is on the left of FIG. 4. After exposure to moisture and being placed on the paper towel, the printed image of the article 45 was not disturbed. Thus, the article did not leave a color shadow on the paper towel where it was first placed 46.

Articles made with the method of the present invention include but are not limited to articles such as toys, figures, two-dimensional images, and other articles that may be miniaturized. Other articles include kits such as jewelry kits and ornaments and ornament kits such as Christmas tree ornament kits. A jewelry kit and ornament kit comprises a shrinkable article of the present invention, a container for the shrinkable article and, optionally coloring agents such as crayons or paint, fastening devices, and other kit components, such as components that attach one shrinkable article to another. In some examples, preprinted, trace lines are included on a shrinkable medium for kids to color (e.g., via marker), cut out, shrink and wear.

The above Detailed Description includes references to the accompanying drawings, which form a part of the Detailed Description. The drawings show, by way of illustration, specific embodiments in which the invention can be practiced. These embodiments are also referred to herein as "examples." Equivalent materials to those disclosed herein may be substituted and utilized in the present articles, methods and kits without departing from the scope of the subject matter.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, references to "an," "one," or "various" embodiments are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

In the appended claims, the terms "including" and "in which" are used as the plain-English equivalents of the respective terms "comprising" and "wherein." Also, in the following claims, the terms "including" and "comprising" are open-ended, that is, a system, assembly, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims.

What is claimed is:

1. A method comprising:

providing one or more shrinkable coatings, wherein at least one of the one or more shrinkable coatings comprise a polyurethane dispersion; and applying the one or more shrinkable coatings to a first major surface of a shrinkable substrate, wherein the one or more shrinkable coatings is configured to accept ink, shrink when exposed to heat and, after shrinking, retain the ink when the ink is exposed to moisture.

2. The method of claim 1, wherein applying the one or more shrinkable coatings includes:

applying a primer to the first major surface of the shrinkable substrate; and applying an ink receptive layer to the first major surface of the shrinkable substrate.

3. The method of claim 2, wherein the primer and the ink receptive layer are the same coating.

4. The method of claim 1, wherein providing the one or more shrinkable coatings include providing a primer comprising the polyurethane dispersion.

5. The method of claim 4, wherein providing a primer comprising the polyurethane dispersion includes providing a primer comprising at least one of a polyether-type polyurethane dispersion or a polycarbonate-type polyurethane dispersion.

6. The method of claim 4, wherein providing a primer comprising a polyurethane dispersion includes providing a primer having a polyurethane dispersion content of between about 5% to about 75% by weight.

7. The method of claim 4, wherein providing a primer comprising a polyurethane dispersion includes providing a primer comprising a polyurethane dispersion and at least one of styrene maleic anhydride, styrene maleimide resin, or styrene maleic anhydride acid resin.

8. The method of claim 1, wherein providing one or more shrinkable coatings includes providing a primer comprising at least one of acrylic styrene, or acrylic.

9. The method of claim 1, wherein providing one or more shrinkable coatings includes providing a primer comprising at least one of vinylpyrrolidone or vinylcaprolactam.

10. The method of claim 1, wherein applying includes applying a primer at a coating rate of between about 0.1 grams/square meter ($g/m^2$) to about 25 ($g/m^2$).

11. The method of claim 1, wherein applying includes applying a primer at a coating rate of between about 0.1 grams/square meter ($g/m^2$) to about 15 ($g/m^2$).

12. A water resistant shrinkable image sheet, comprising:

a shrinkable substrate; and a shrinkable coating including a polyurethane dispersion attached to at least one major surface of the substrate, the shrinkable coating configured to receive ink and retain the ink when exposed to moisture;

wherein the shrinkable substrate and the shrinkable coating are configured to shrink at substantially the same rate when exposed to heat.

13. The shrinkable image sheet of claim 12, wherein the shrinkable coating includes at least one of vinylpyrrolidone or vinylcaprolactam.

14. The shrinkable image sheet of claim 12, wherein the shrinkable coating includes a primer comprising at least one of styrene maleic anhydride, styrene maleimide resin, or styrene maleic anhydride acid resin.

15. The shrinkable image sheet of claim 12, wherein the shrinkable coating includes a primer layer and an ink receptive layer, wherein the ink receptive layer includes at least one of styrene maleic anhydride, styrene maleimide resin, or styrene maleic anhydride acid resin.

16. The shrinkable image sheet of claim 12, wherein the shrinkable coating includes at least one of colloidal silicate or alumina oxide.

17. The shrinkable image sheet of claim 12, wherein the shrinkable coating includes at least one of silica, clay, calcium carbonate, titanium or alumina to provide a matte finish.

18. The shrinkable image sheet of claim 12, wherein the shrinkable substrate comprises polystyrene.

19. The shrinkable image sheet of claim 12, wherein the shrinkable substrate comprises bi-axially oriented polystyrene.

20. The shrinkable image sheet of claim 12, wherein the shrinkable substrate and the shrinkable coating have an area, and the shrinkable substrate and the shrinkable coating are configured to shrink to about 25% of the area when subjected to heat in a range of about 300° F. to about 425° F. for about 2 minutes to about 10 minutes.

* * * * *